US012232562B2

(12) United States Patent
Urbano

(10) Patent No.: US 12,232,562 B2
(45) Date of Patent: Feb. 25, 2025

(54) INSOLE FOR FOOTWEAR

(71) Applicant: Ernesto Urbano, Vienna (AT)

(72) Inventor: Ernesto Urbano, Vienna (AT)

( * ) Notice: Subject to any disclaimer, the term of this patent is extended or adjusted under 35 U.S.C. 154(b) by 86 days.

(21) Appl. No.: 17/776,881

(22) PCT Filed: Nov. 13, 2020

(86) PCT No.: PCT/IB2020/060690
§ 371 (c)(1),
(2) Date: May 13, 2022

(87) PCT Pub. No.: WO2021/094991
PCT Pub. Date: May 20, 2021

(65) Prior Publication Data

US 2022/0338596 A1 Oct. 27, 2022

(30) Foreign Application Priority Data

Nov. 14, 2019 (IT) ..... 102019000021222

(51) Int. Cl.
*A43B 7/08* (2022.01)
*A43B 17/08* (2006.01)

(52) U.S. Cl.
CPC ..... *A43B 17/08* (2013.01); *A43B 7/081* (2013.01)

(58) Field of Classification Search
CPC ..... A43B 17/08; A43B 7/081; A43B 5/165; A43B 7/06
See application file for complete search history.

(56) References Cited

U.S. PATENT DOCUMENTS 3,426,455 A * 2/1969 Drago ..... A43B 17/08 36/3 R
3,475,836 A * 11/1969 Brahm ..... A43B 17/08 36/3 R
6,006,447 A 12/1999 Neal et al.
(Continued)

FOREIGN PATENT DOCUMENTS

CN 201878895 U 6/2011
EP 0887029 A2 12/1998
(Continued)

OTHER PUBLICATIONS

International Search Report and Written Opinion dated Feb. 15, 2021 from counterpart International Patent Application No. PCT/IB2020/060690.

*Primary Examiner* — Katharine G Kane
(74) *Attorney, Agent, or Firm* — SHUTTLEWORTH & INGERSOLL, PLC; Timothy J. Klima

(57) ABSTRACT

Described is an insole including: a first body having an upper surface, having a first channel, extending close to an edge of said upper surface, and a second channel, extending between a central zone and an edge of said upper surface; a second body, in contact with the upper surface of the first body for closing said first and second channels, including at least a first through opening, positioned at the first channel, and at least a second through opening, positioned at the second channel; an attachment, constrained to said first and second body, including at least a first conduit, in fluid communication with the first channel and with the outside environment, and at least a second conduits, in fluid communication with the second channel and with the outside environment.

7 Claims, 6 Drawing Sheets

(56) References Cited

U.S. PATENT DOCUMENTS

| | | | | |
|---|---|---|---|---|
| 6,041,519 | A * | 3/2000 | Cheng | A43B 17/08 36/35 B |
| 6,196,556 | B1 * | 3/2001 | Bonaventure | A43B 7/081 280/11.202 |
| 2006/0168846 | A1 * | 8/2006 | Juan | A43B 17/08 36/43 |
| 2009/0044431 | A1 | 2/2009 | Hypponen | |
| 2012/0266494 | A1 * | 10/2012 | Ko | A43B 7/087 36/30 R |
| 2016/0007685 | A1 * | 1/2016 | Lin | A43B 17/08 36/44 |
| 2016/0029740 | A1 * | 2/2016 | Möhlmann | A43B 13/203 36/3 B |
| 2020/0383423 | A1 * | 12/2020 | Lee | A43B 7/18 |

FOREIGN PATENT DOCUMENTS

| | | | |
|---|---|---|---|
| GB | 2195074 | A | 3/1988 |
| GB | 2250417 | A | 6/1992 |
| JP | 2002085103 | A | 3/2002 |
| WO | 2016037593 | A1 | 3/2016 |

* cited by examiner

INSOLE FOR FOOTWEAR

This application is the National Phase of International Application PCT/IB2020/060690 filed Nov. 13, 2020 which designated the U.S.

This application claims priority to Italian Patent Application No. 102019000021222 filed Nov. 14, 2019, which application is incorporated by reference herein.

TECHNICAL FIELD

This invention relates to an insole for an item of footwear and an item of footwear comprising the insole.

In particular, the invention relates to an insole for footwear which is particularly suitable for allowing, in use, an effective aeration of the foot when enclosed by the upper by the item of footwear.

BACKGROUND ART

In their basic form, the insoles for footwear are elements, generally removable, positioned inside the item of footwear at the top of the sole of the item of footwear.

In use, that is to say, when a user's foot is inserted inside the item of footwear, the insoles are interposed between the sole of the item of footwear and the sole of the user's foot, so as to make the use of the footwear more comfortable for the user.

Generally speaking, the sole of the item of footwear consists of particularly rigid materials and has a mainly flat extension, which does not adapt well to the shape of the sole of the user's foot, which would thus feel discomfort if the support were acting directly on the sole.

In order to make the use of the item of footwear more comfortable, an insole is inserted above the sole, the purpose of which is to receive the sole of a user's foot with a suitable shape in the face facing towards the inside of the item of footwear.

Advantageously, this shape of the insole is specular to the sole of the foot so as to receive the user's foot in an optimum manner.

The insoles are generally made of expanded polyurethane, leather, gel or latex.

In their most basic forms, these insoles have the form of a single body, without aeration systems.

This lack of aeration causes an increase in the temperature and humidity inside the item of footwear, in particular at the point of contact between the sole of the foot and the insole, with a consequent feeling of discomfort for the user.

In order to guarantee an improved aeration of the foot, insoles have been designed with aeration structures to allow an exchange of air in the contact zone between the sole of the foot and the insole.

One of the most frequently used solutions is that of using insoles having holes which act in conjunction with suitable channels preferably semi-permeable (that is, permeable to air and water vapour but impermeable to water) made in the sole of the item of footwear, to allow an exchange of air.

This solution, however, has the drawback of preventing interchangeability and compatibility of the insole with other footwear, since there is an almost unique association between the holes in the insole and the channels in the sole of the item of footwear.

Other solutions, which at the same time allow aeration of the foot and compatibility of the insole with several footwear, have been adopted.

U.S. Pat. No. 6,006,447 A illustrates an insole for multilayer footwear formed by several layers, of which at least one is made of breathable foam, and a lateral attachment for extracting air from the inside of the item of footwear to the outside environment.

This solution has the drawbacks of not allowing an adequate aeration under static conditions, that is to say, when the user does not walk, and also needing special spongy elements equipped with special connected holes.

Patent document US 2009/0044431 A1 illustrates an insole for footwear equipped with an aeration system consisting of an inner channel, extending from the zone of the heel to the zone of the tip, and an extraction conduit connected to said inner channel and to the outside environment.

However, these solutions provide for the presence of a single aeration means, which only extracts or only introduces air, without allowing a total exchange in the entire zone below the sole of the user's foot.

This results in an only partial aeration and a limited sensation of comfort for the user, who has only some zones of the foot which are cooled by the action of the aeration system.

DISCLOSURE OF THE INVENTION

The aim of the invention is to overcome the above-mentioned drawbacks of the prior art, optimising the process for exchanging air in the insole of an item of footwear.

The aim of the invention is to provide an insole for footwear equipped with an aeration system which is compatible with different types of footwear and which allows an exchange of air on an area as large as possible of the insole.

Another aim is to provide an insole and an item of footwear which guarantee to the user a feeling of freshness and comfort on the entire sole of the foot, without any zone being unaffected by the air exchange action.

A further aim of the invention is to provide an insole with a simple manufacturing structure and therefore also inexpensive to manufacture.

The technical features of the invention may be easily inferred from the present disclosure.

BRIEF DESCRIPTION OF DRAWINGS

The advantages of the invention will also become more apparent from the detailed description which follows, with reference to the accompanying drawings which illustrate a preferred, non-limiting example embodiment of the invention and in which.

DETAILED DESCRIPTION OF PREFERRED EMBODIMENTS OF THE INVENTION

With reference to the accompanying drawings, the numeral 100 denotes an insole for footwear, hereinafter simply referred to as insole 100.

In its traditional form, an insole for footwear is shaped in such a way as to be inserted, in a substantially stable manner, in contact with a sole of an item of footwear, so as to guarantee a comfortable fit for a user (user, wearer of the item of footwear).

In particular, the insole is shaped in such a way as to follow the shape of the sole of the item of footwear and has in its upper surface areas in relief and dips in order to better adapt to the shape of the sole of the wearer's foot.

For example, dips in the insole are present in the zones which will make contact with the heel and the toes of the foot, whilst a relief area is present in a zone which is to support the plantar arch of the user.

Figure 1:
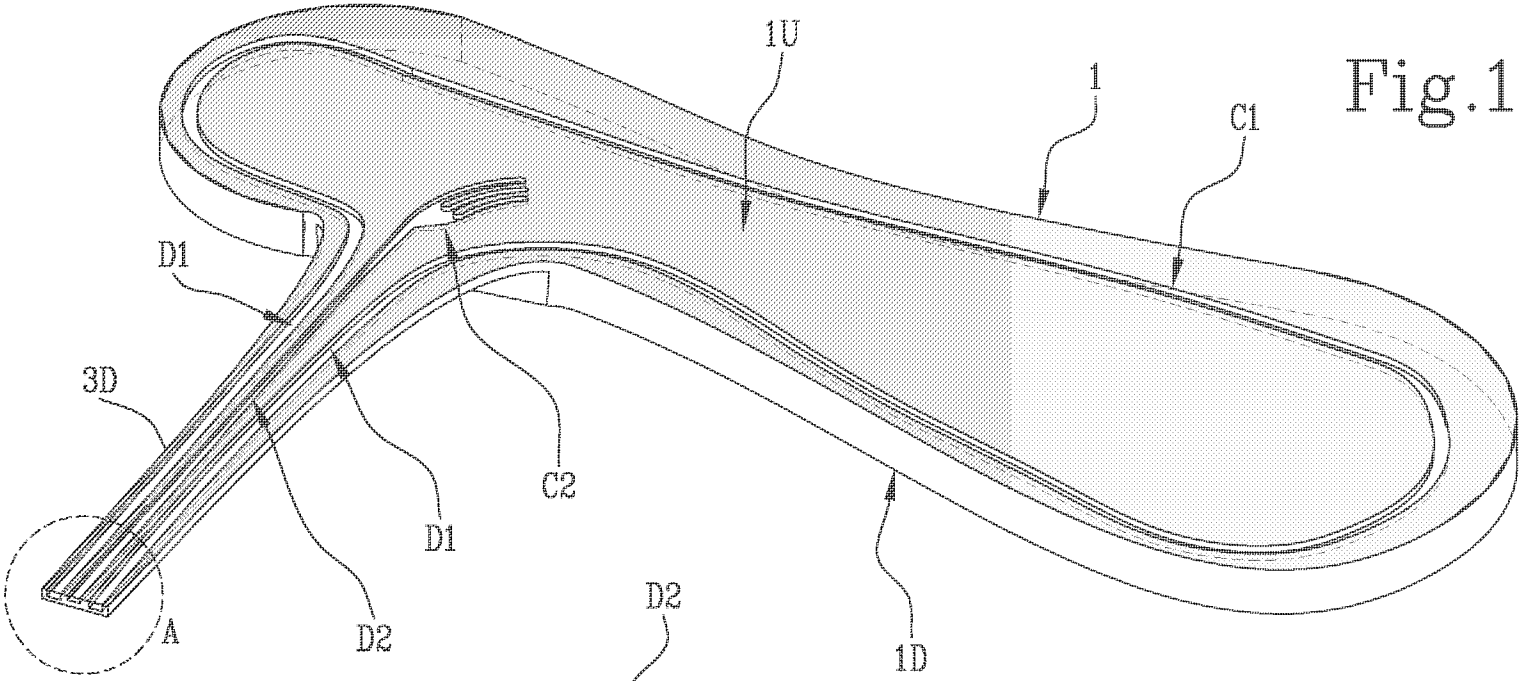
FIG. 1 is a perspective view of a portion of the insole according to the invention.
Figure 1A:
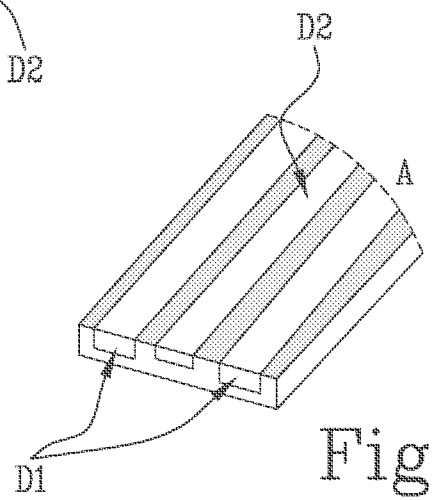
FIG. 1A illustrates a detail of the portion of the insole of FIG. 1.

As illustrated in the accompanying drawings and in particular in FIG. 1, the insole 100 comprises a first body 1.

The first body 1 has an upper surface 1U and a lower surface 1D.

In use, said lower surface 1D is configured to come into contact with the sole of an item of footwear whilst the upper surface 1U faces towards the sole of a user's foot wearing the item of footwear in which the insole 100 is inserted, although without there being direct contact between the sole of the foot and the upper surface 1U, as described in more detail below.

According to an aspect of the invention, the upper surface 1U comprises a first groove defining a first channel C1.

In other words, said first groove represents a non-through groove or cavity, that is, not passing through the first body in its entirety.

The above-mentioned groove may be made directly during the step of manufacturing the first body 1, preferably by moulding, or it may be made by removal of material from the first body 1, which is therefore manufactured with a continuous upper surface 1U and machined at a later time.

In particular, said first channel C1 extends close to at least part of an edge of the upper surface 1U, that is, in a peripheral zone of said upper surface 1U.

According to an embodiment, illustrated for example in FIG. 1, said first channel C1 forms an open circuit between a first opening at the edge of the upper surface 1U and a second opening also at the edge of the upper surface 1U.

Preferably, the first channel C1 extends close to the edge of the upper surface 1U along the longest trajectory between the above-mentioned first and second openings.

According to an alternative embodiment, the first channel C1 comprises a closed path, extending close to the edge of the upper surface 1U, and a sub-channel, extending between the closed path and at least one opening at the edge of said upper surface 1U.

It should be noted that, according to a variant embodiment not illustrated, the first channel C1 may be made in several portions: a first portion for feeding the flow of air from the attachment 3 towards the inside of the item of footwear, and a second portion for returning the flow of air from the inside of the item of footwear to the attachment 3.

The two portions may be joined with or without interruptions.

Preferably, a part of both of the portions covers the same zone of the item of footwear, in such a way that there can be a continuity of flow between the air entering the first portion (entering from the attachment 3) and the return air from the second portion (leaving from the attachment 3).

The first channel c1 (the first portion for feeding the flow) branches into a plurality of secondary channels.

Similarly, the first channel c1 (the second portion for returning the flow) branches into a plurality of secondary channels. The secondary feed and return channels are close together in a flow exchange area. The secondary channels (first and second) are, preferably, open only upwards, that is, inside the item of footwear, by means of a plurality of openings. In the zone for exchange of the flows, the air leaving from the openings of the first feed portion enters, pushed by the movement of the foot when walking, into the secondary channels of the second return portion (entering through the respective openings).

According to another aspect of the invention, the upper surface 1U comprises at least a second groove defining at least a second channel C2.

Like the first groove, the second groove also represents a non-through groove or cavity, that is, not passing through the first body in its entirety.

Moreover, the second groove may also be formed directly during the step of manufacturing the first body 1 or it may be made by removal of material from the first body 1.

The second channel C2 extends between a central zone, that is to say, not close to the edges, of the upper surface 1U and an edge of the surface of the upper surface 1U, at an opening.

According to the embodiment of FIG. 1, the second channel C2 comprises three sub-channels, which meet in a single channel close to the edge of the upper surface 1U according to a "fork-shaped" arrangement.

According to an alternative embodiment, the at least a second channel C2 may comprise a plurality of channels which extend between the edge of the upper surface 1U and various points of the central zone of the upper surface 1U.

According to an embodiment, the first body 1 is made of expanded polyurethane.

According to another embodiment, the first body 1 is made of latex.

According to yet another embodiment, the first body 1 is made of gel.

According to a further embodiment, the first body 1 is made of cork.

Figure 2:
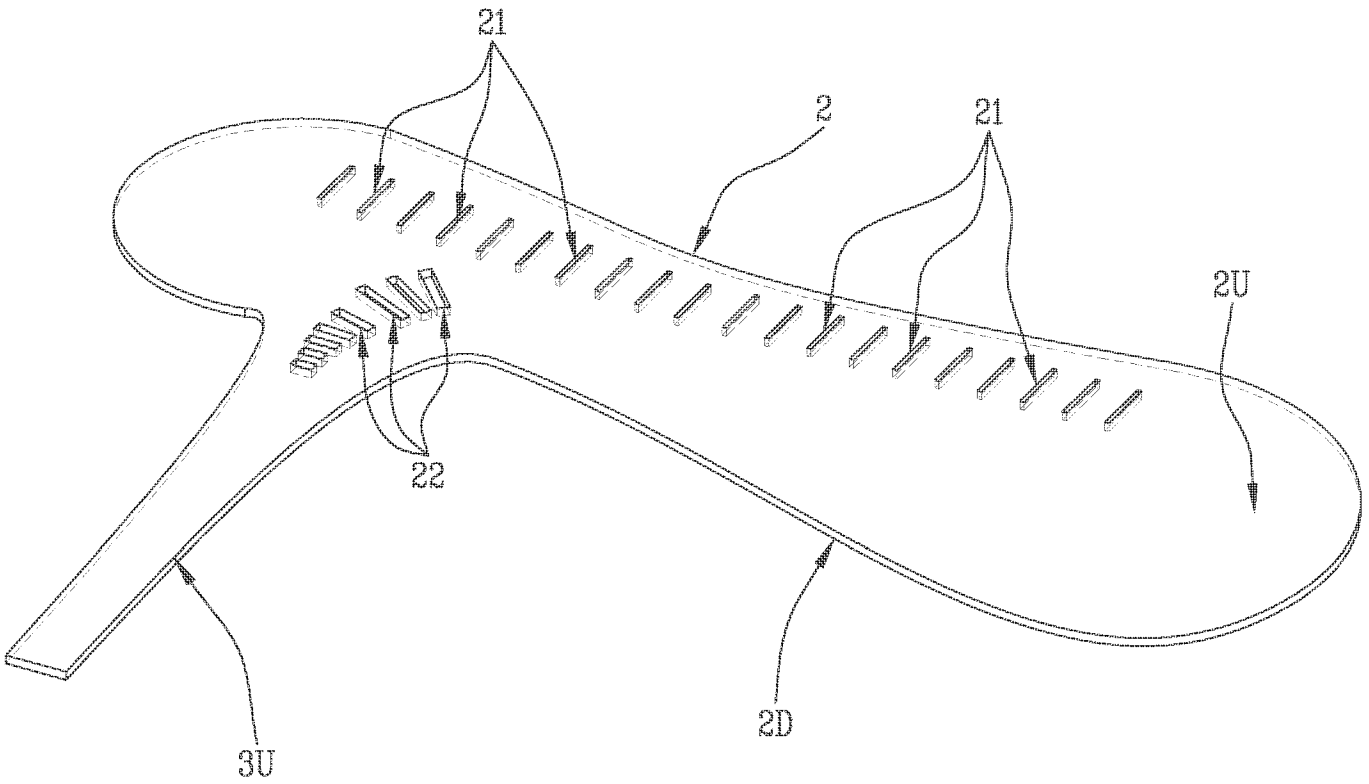
FIG. 2 is a perspective view of another portion of the insole according to the invention.

According to an aspect of the invention, the insole 100 comprises a second body 2, illustrated in particular in FIG. 2.

The second body 2 has a first lower surface 2D and a second upper surface 2U.

When the insole 100 is assembled, the first surface 2D is in contact with the upper surface 1U of the first body 1 for covering, at least partly, said first and second channels C1, C2.

The second surface 2U is positioned on the side of the second body 2 opposite to that of the first surface 2D, and thus, in use, faces towards the sole of a user's foot.

According to an embodiment, the second surface 2U comes into direct contact with the sole of the user's foot using the item of footwear in which the insole 100 is inserted.

According to alternative embodiments, other elements are interposed between the sole of the user's foot and the second surface 2U, which are therefore not in contact.

In particular, when the insole 100 is assembled, the first body 1 is integral with the second body 2.

According to an embodiment, the constraint between the first body 1 and the second body 2 may be accomplished by welding, for example by ultrasonic welding.

According to another embodiment, the constraint between the first body 1 and the second body 2 may be accomplished by the use of connecting means, for example by means of glue.

According to an aspect of the invention, the second body 2 comprises at least a first through opening 21.

According to the embodiment of FIG. 2, the second body 2 comprises a plurality of first openings 21, more specifically, twenty first openings 21 positioned along at least a part of the extension of the channel C1 (offset in height relative to the channel C1 when the insole 100 is assembled) to define slots (with a longitudinal extension perpendicular to the direction of extension of the channel C1).

According to alternative embodiments, the at least a first opening 21 may adopt variations relative to the embodiment of FIG. 2 both in terms of number and shape.

In use, that is to say, when the first body 1 and the second body 2 are connected to each other, the at least a first opening 21 is positioned at least at part of the first channel C1.

In this way, the first channel C1 is placed in fluid communication with the environment facing the second surface 2U of the second body 2.

In this description, the term "fluid communication between environments" is used to mean the possibility for a fluid, such as air, to pass from one environment to another, and vice versa, by means of an opening or wall permeable to the fluid.

According to a further aspect of the invention, the second body 2 comprises at least one second through opening 22.

According to the embodiment of FIG. 2, the second body 2 comprises a plurality of second openings 22 with a variable rectangular cross-section.

According to alternative embodiments, the at least a second opening 22 may adopt variations relative to the embodiment of FIG. 2 both in terms of number and shape.

In use, that is to say, when the first body 1 and the second body 2 are connected to each other, the at least a second opening 22 is positioned at least at part of the second channel C2.

In this way, the second channel C2 is placed in fluid communication with the environment facing the second surface 2D of the second body 2.

According to an embodiment, the second body 2 is made of expanded polyurethane.

According to another embodiment, the second body 2 is made of latex.

According to yet another embodiment, the second body 2 is made of gel.

According to a further embodiment, the second body 2 is made of cork.

According to additional embodiments, the second body 2 is made of leather or synthetic fabric.

As illustrated in the accompanying drawings, the insole 100 comprises an attachment 3.

Preferably, said attachment 3 is positioned laterally.

Advantageously, in this way, the insole 100 can be used in any item of footwear.

The attachment 3 is connected to the first body 1 and to the second body 2, when the insole 100 is assembled.

Preferably, the attachment 3 is constrained to the first and to the second body 1, 2 in an inner zone 100X of the insole 100 (preferably lateral), that is to say, in a zone which in use is close to the inside of the foot of the user wearing the item of footwear equipped with the insole 100.

The attachment 3 has a main axis of extension 3X, along which the attachment extends between a zone of contact with the first and the second body 1, 2 and a free end.

More specifically, the attachment 3 extends along said main axis of extension 3X for a length of between 1 cm and 40 cm.

Advantageously, this length allows, in use, at least the free end of the attachment 3 to come out of the item of footwear, that is to say, to emerge from the upper of the item of footwear close to the ankle or leg of the user.

According to an aspect of the invention, the attachment 3 comprises at least a first conduit D1, in fluid communication with the first channel C1 and with the environment outside the item of footwear in which the insole 100 is installed.

The attachment 3 also comprises at least a second conduit D2, in fluid communication with the at least a second channel C2 and with the outside environment.

Figure 3:
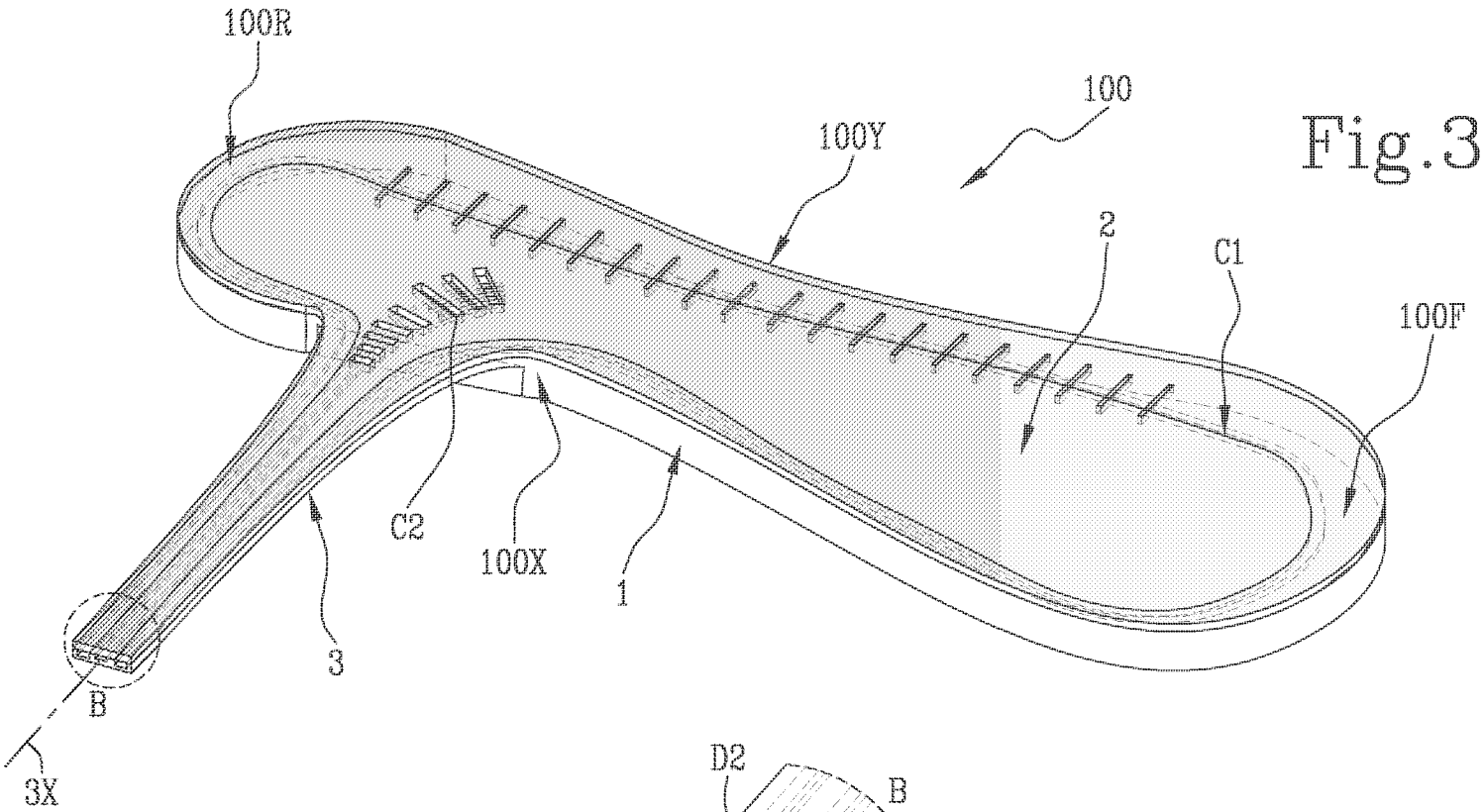
FIG. 3 is a perspective view of a first embodiment of the insole according to the invention.
Figure 3A:
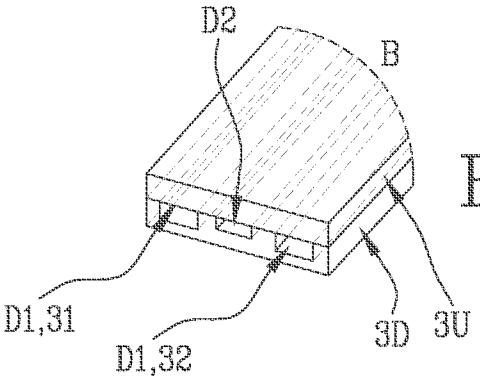
FIG. 3A illustrates a detail of the insole of FIG. 3.
Figure 4:
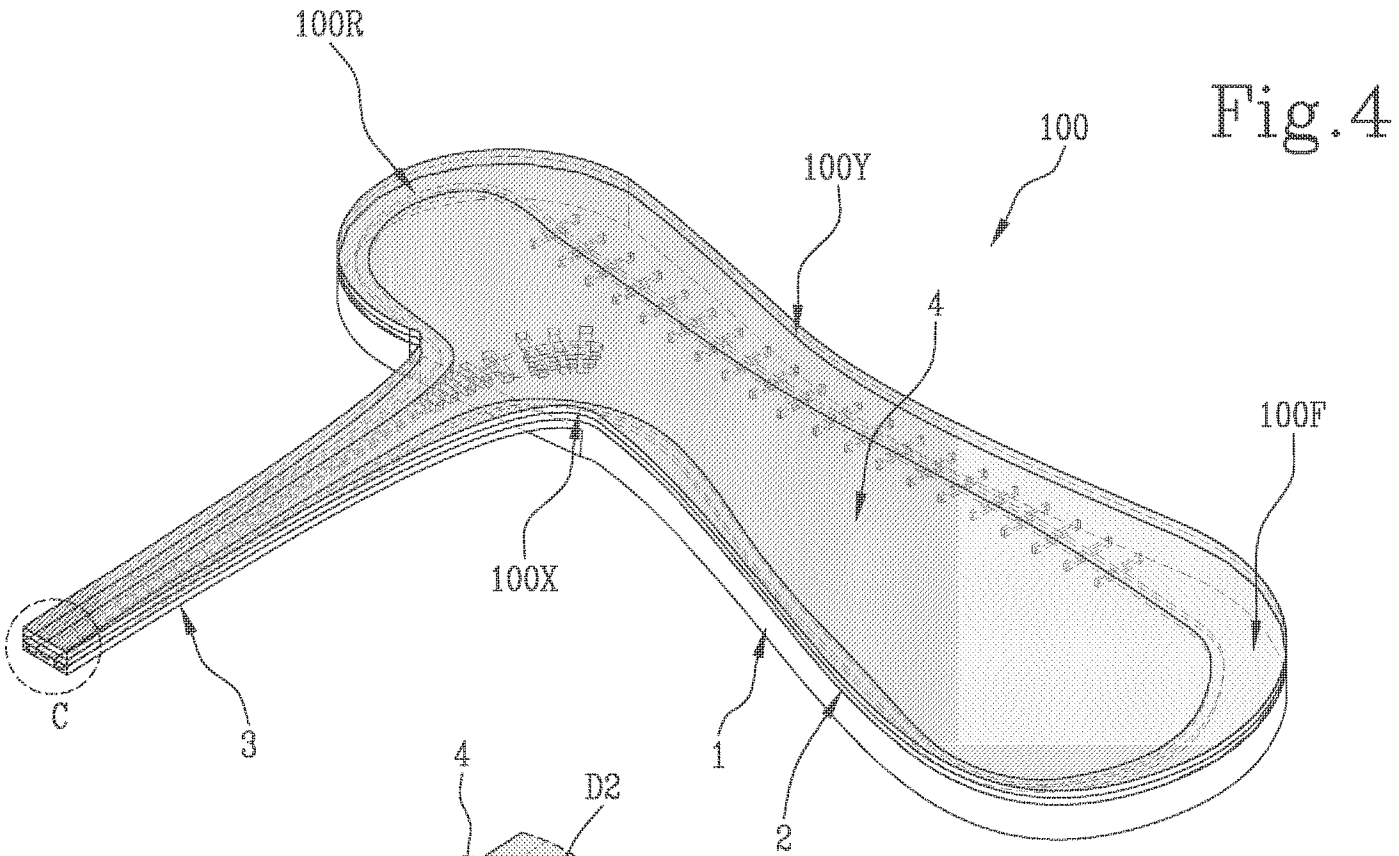
FIG. 4 is a perspective view of a second embodiment of the insole according to the invention.
Figure 4A:
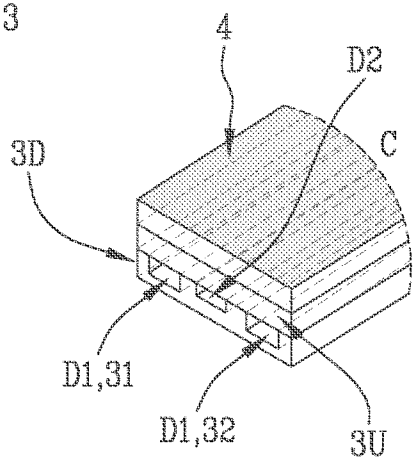
FIG. 4A illustrates a detail of the insole of FIG. 4.
Figure 5:
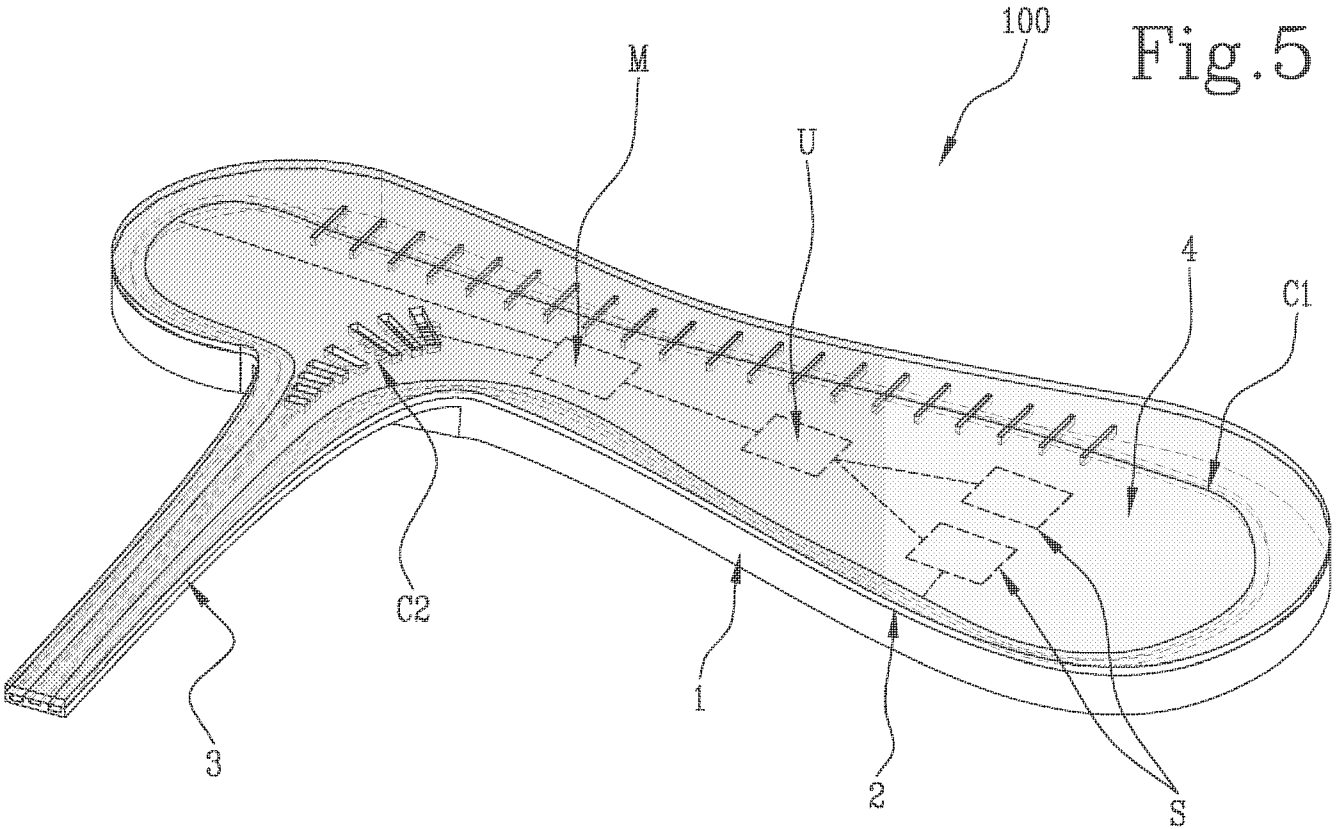
FIG. 5 is a perspective view of a third embodiment of the insole according to the invention.

According to an embodiment, illustrated in particular in FIG. 3 and in detail in FIG. 3A, the attachment 3 comprises a lower portion 3D and an upper portion 3U.

The lower portion 3D, illustrated in FIG. 1, has a plurality of grooves defining the at least a first conduit D1 and the at least a second conduit D2.

Like the grooves present in the first body 1, the grooves present on the lower portion 3D also represent non-through grooves or cavities, that is to say, not passing through the lower portion of the attachment 3 in its entirety.

The grooves may be made directly during production of the lower portion 3D or may be made by removal of material.

According to an embodiment, illustrated in FIG. 1, the first body 1 and the lower portion 3D of the attachment 3 are made as one.

In this description, the expression "made as one" means that two pieces constitute a single piece, that is to say, they are made in a single element.

The upper portion 3U, illustrated in FIG. 2, is configured for covering said at least a first and at least a second conduit D1, D2.

Preferably, as illustrated in FIG. 2, the upper portion 3U has a plurality of through openings at least at part of the at least a second conduit D2, for putting in fluid communication the second conduit D2 with the outside environment on which the upper portion 3U faces.

According to an embodiment, illustrated in FIG. 2, the second body 2 and the upper portion 3U of the attachment 3 are made integrally.

According to the embodiment illustrated in the accompanying drawings, the at least a first conduit D1 comprises an inlet conduit 31 and an outlet conduit 32.

The inlet conduit 31 and the outlet conduit 32 are in fluid communication with the first channel 31, by means of a first opening, and with the outside environment, by means of a second opening.

The inlet conduit 31 and the outlet conduit 32 are configured for the circulation in the first channel C1 of fluid, such as air, to and from the outside environment.

According to this embodiment, the at least a second conduit D2 comprises a single conduit in fluid communication with the second channel C2, by means of a first opening, and with the outside environment, by means of a second opening.

According to alternative embodiments, the at least a first conduit D1 or the at least a second conduit D2 may comprise a different number of conduits in fluid connection, respectively, with the first channel C1 and the at least a second channel C2.

Preferably, the insole 100 comprises a breathable covering element 4, in contact with the second upper surface 2U of the second body 2 and with the attachment 3.

In use, the covering element 4 covers at least partly the second body 2 and the attachment 3 so as to avoid contact between the sole of the user's foot with the materials of which the second body 2 and the attachment 3 are made, thus guaranteeing greater comfort for the user.

The covering element 4 is configured, in use, as a contact element between the insole 100 and the sole of the user's foot.

The breathable property of the covering element 4 allows the fluid in circulation in the first channel C1 and in the at least a second channel C2 to pass through the first and second openings 21, 22 of the second body 2 and to touch the environment in contact with the covering element 4, which in use coincides with the environment inside the item of footwear in which the user's foot is housed.

According to an embodiment, the covering element 4 is made of breathable fabric.

According to another embodiment, the covering element 4 is made of breathable leather.

According to yet another embodiment, the covering element 4 is made of cork.

Preferably, the insole 100 comprises at least one motor M.

The motor M is operatively associated with at least one of either said first channel C1 or second channel C2.

Preferably, said motor M is housed in a seat present in said first body 1.

The motor M is configured to move the fluid in at least one of either said first channel C1 or said second channel C2 and to facilitate the flowing of the fluid in the channels.

In its generic form, the motor M used in the insole 100 comprises an actuator for moving a fluid and a power supply element for powering said actuator.

Said actuator is therefore operatively connected to, preferably interfaced on, at least one between the first channel C1 and the second channel C2.

According to an embodiment, the actuator comprises a micro-fan designed to be contained inside the insole 100.

The operation of the micro-fan moves the fluid inside the channel, or channels, to which it is operatively connected.

The actuator is also operatively connected to the power supply element for powering the actuator.

According to an embodiment, the power supply element comprises a battery.

Preferably, the battery is of the rechargeable type.

According to an embodiment, the battery is rechargeable by a cable or by an inductive coupling (for example a docking station) when the plantar is not in use.

According to another embodiment, the power supply element comprises a device which is able to transform and store the kinetic energy dissipated by the user during walking into electricity for powering the actuator.

According to this embodiment, the actuator may be powered, even in real time, that is to say, without accumulating electricity, by the power supply element.

Preferably, the insole 100 comprises at least one sensor S.

The at least one sensor S is, preferably, operatively connected to at least one between the first channel C1 and the second channel C2.

According to an embodiment, the at least one sensor S comprises an accelerometer configured for measuring the accelerations to which the insole 100 is subjected.

According to another embodiment, the at least one sensor S comprises a temperature sensor configured to measure a temperature value, for example inside the first channel C1 or the second channel C2.

According to yet another embodiment, the at least one sensor S comprises a humidity sensor configured to measure a humidity value, for example inside the first channel C1 or the second channel C2.

The at least one sensor S is powered by an internal power supply element or through the power supply element of the motor M.

Again preferably, the insole 100 comprises a command and control unit U.

The command and control unit U is operatively connected to at least one of either said motor M or at least one sensor S.

According to an embodiment, the command and control unit U is operatively connected to the sensor S to receive the value measured by the at least one sensor.

Based on this value, the command and control unit U processes a control signal, preferably electric, for the motor M.

The command and control unit U is powered by an internal power supply element or through the power supply element of the motor M.

The embodiment illustrated in the accompanying drawings is described below.

According to the embodiment illustrated, the insole 100 comprises a single first channel C1 and a second channel C2 which branches towards the inner area of the insole into three sub-channels.

According to this embodiment, the first channel C1 extends between an area of contact with the inlet conduit 31 in the inner zone 100X of the insole 100 and an area of contact with the outlet conduit 32 in the same inner zone 100X.

The first channel C1 defines an aeration path passing through a rear zone 100R, an outer zone 100Y, a front zone 100F and at least part of the inner zone 100X of the insole 100.

Advantageously, this type of shape allows the first channel C1 to touch a large percentage of the edge of the upper surface 1U, basically not touching the part interposed between the zones of contact with the inlet conduit 31 and the outlet conduit 32.

The area not touched by the first channel 31 is partly touched by the second channel C2, so as to have a large covering of the upper surface 1U without adversely affecting the stability and the comfort of use of the insole 100.

Advantageously, the shape of the embodiment illustrated allows the implementation of two aeration modes.

The first method, the so-called "passive aeration" mode, consists in the passive exchange of air inside the channels C1, C2 and conduits D1, D2 present in the insole 100, substantially by convection.

When the user does not load his/her weight on the insole (for example, when he/she is seated), the first and second channels C1, C2 are open and the hot air present is free to move until reaching the first and second conduits D1, D2 and, subsequently, the outside environment.

The second method, the so-called "active aeration" mode, consists in the distribution of loads, that is to say, the body weight of the user, during walking in order to create a guided flow of air, in particular inside the first channel C1.

Typically, during walking, the user distributes his/her weight in a dynamic manner, initially concentrating the load at the heel of the foot, and therefore at the rear zone 100R of the insole 100.

Subsequently, the user redistributes his/her weight more and more forwards, preferably in the lateral portion of the foot, at the outer zone 100Y.

Lastly, before detaching the foot from the ground, the weight of the user is concentrated almost completely in the front zone 100F.

This dynamic redistribution of the weight results in local elastic flattening, in particular of the first channel C1, and the consequent guided movement of the air inside the channel.

Advantageously, the shape of the first channel C1 and the dynamic redistribution of the weight allow the movement of the air present in the first channel C1 towards the outlet conduit 32, and therefore towards the outside environment.

Consequently, according to the principle of the peristaltic pump, fresh air is drawn from the outside environment through the inlet conduit 31 into the first channel C1, in particular at the zones of the first channel C1 which, after being subject to elastic flattening, is again open.

The second channel C2 and the second conduit D2 touch a zone of the insole 100 in contact with the arch of the foot, where typically the weight of the user is discharged only to a minimum extent.

Thus, the second channel C2 remains substantially open and does not undergo particular elastic flattening, operating almost constantly in passive aeration mode.

The invention also relates to an item of footwear 200 equipped with an aeration system, hereinafter simply referred to as an item of footwear 200.

Figure 6:
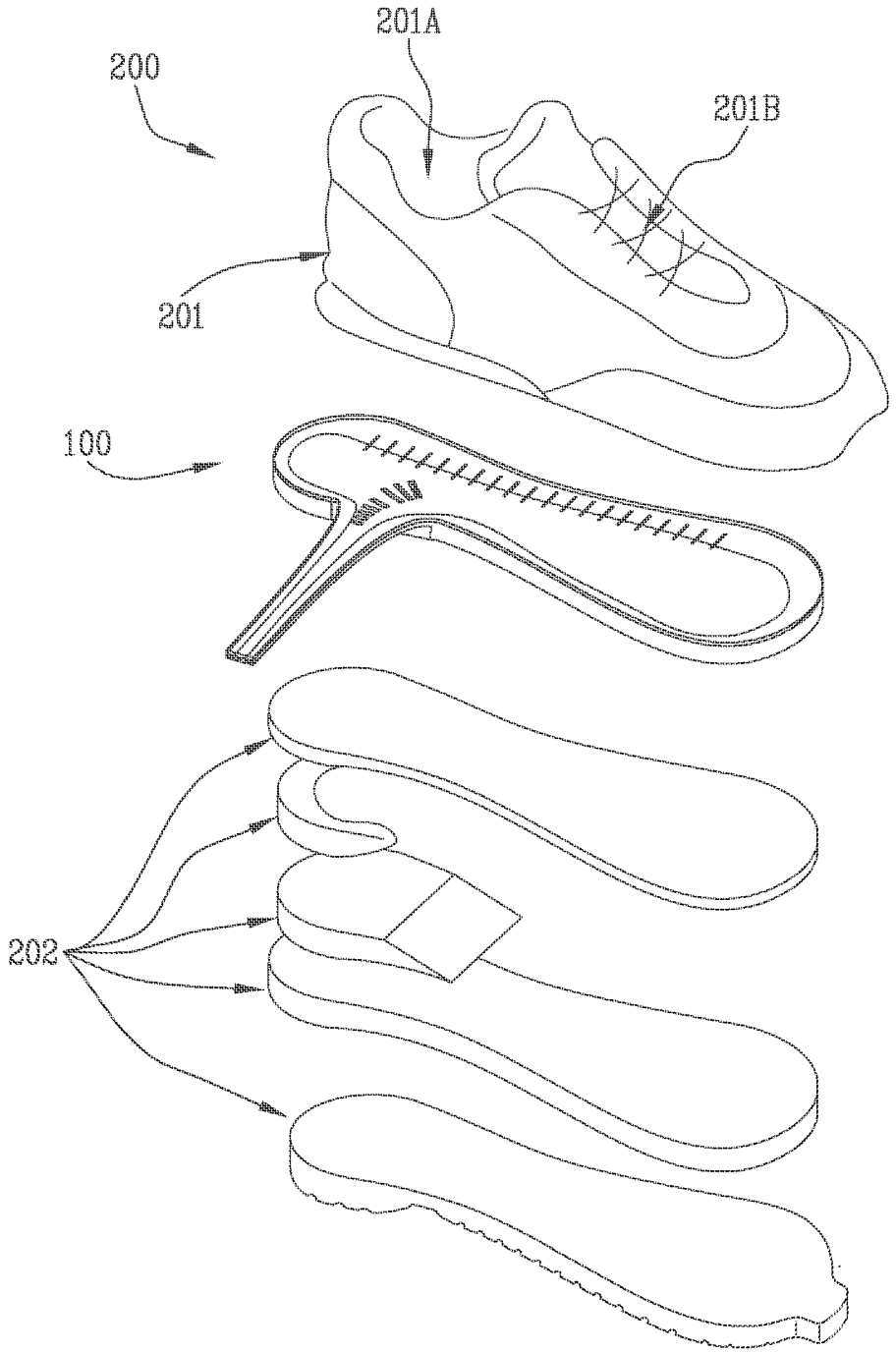
FIG. 6 illustrates, according to a perspective exploded view, an item of footwear, also according to this invention, comprising the insole of FIG. 4.

As illustrated in FIG. 6, the item of footwear comprises an upper 201, designed to wrap around the foot of the user who wears the item of 200.

In particular, the upper 201 has an opening 201A for inserting the foot inside the item of footwear 200.

According to an embodiment, the upper 201 is made of leather.

According to another embodiment, the upper 201 is made of fabric.

Preferably, the upper 201 comprises a closing system 201B for keeping, in use, the user's foot stably inside the item of footwear 200.

According to an embodiment, the closing system 201B comprises at least one lace.

According to another embodiment, the closing system 201B comprises at least one buckle or a Velcro strap.

According to an aspect of the invention, the item of footwear 200 comprises a sole 202 designed to come into contact, in use, with a supporting element, for example the ground.

The sole 202 is connected, in particular constrained, to the upper 201.

As illustrated in FIG. 6, the sole 202 preferably comprises a plurality of layers, possibly made of different materials.

The item of footwear 200 also comprises the insole 100 according to one of the embodiments described above.

In particular, according to the embodiment of FIG. 6, the insole 100 has the attachment 3 located at the inner zone 100X, in a position such as to allow, in use, the attachment 3 to be positioned close to the user's ankle, in particular in the zone between the mallelus and the Achilles tendon.

The attachment 3 also has a length such as to allow the free end of the attachment to come out from the opening 201A and facilitate the exchange of air with the outside environment.

Advantageously, this shape of the insole 100 allows the user wearing the item of footwear 200 to perceive a high level of comfort, since the described positioning of the attachment 3 does not generally cause discomfort during use and maximises the efficiency of the aeration system.

The insole according to the invention overcomes the drawbacks of the prior art and achieves the aims indicated above.

In particular, the invention described provides an insole for footwear equipped with an optimised aeration system which allows an exchange of air on a large area of the insole.

In this way, the user is guaranteed a feeling of freshness and comfort on the entire sole of the foot, without any zone being unaffected by the air exchange action.

This insole is compatible with different types of footwear and can be used interchangeably.

The structure of the insole allows an insole to be provided whose manufacturing process is particularly simple and inexpensive.

A further advantage of the invention is to provide an item of footwear equipped with an aeration system which is able to give a maximised sensation of comfort for the user wearing the item of footwear.

The invention claimed is:

1. An insole for footwear, the insole comprising:

a first body including an upper surface comprising a first groove defining a first channel, extending close to at least part of an edge of said upper surface, and a second groove defining a second channel, extending between a central zone of said upper surface and an edge of the upper surface;

a second body having a first lower surface, in contact with the upper surface of the first body for closing said first channel and said second channel, and a second upper surface, said second body comprising a first through opening, positioned, in use, at least at part of the first channel, and a second through opening, positioned, in use, at least at part of the second channel;

an attachment, connected to said first body and second body, in turn comprising: a first conduit, in fluid communication with the first channel and with an outside environment, and a second conduit, in fluid communication with the second channel and with the outside environment;

wherein the first conduit comprises two conduits, an inlet conduit and an outlet conduit, for circulation in the first channel of fluid to and from the outside environment;

the first channel forming part of a peristaltic pump where movement of a foot of the user causes alternating flattening and opening of the first channel to cause the circulation in the first channel; and a breathable covering element, in contact with the second upper surface of the second body and with the attachment;

at least one motor, operatively connected with one or both of said first channel and said second channel, housed in a seat in said first body and configured for moving the fluid in at least one or both of said first channel and said second channel;

the at least one motor comprising an actuator for moving the fluid and a power supply element for powering said actuator;

the at least one motor and actuator configured to move the fluid towards the attachment.

2. The insole according to claim 1, wherein the attachment is connected to the first body and to the second body in an inner zone of the insole.

3. The insole according to claim 1, wherein the attachment comprises a lower portion, having a plurality of grooves defining the first conduit and the second conduit, and an upper portion, configured for covering said first and second conduit.

4. The insole according to claim 3, wherein the first body and the lower portion of the attachment are made monolithically and wherein the second body and the upper portion of the attachment are made monolithically.

5. The insole according to claim 1, wherein the attachment has a main axis of extension and wherein the attachment extends along said main axis of extension for a length of between 1 cm and 40 cm.

6. The insole according to claim 1, wherein the first channel extends between an area of contact with the inlet conduit in the inner zone of the insole and an area of contact with the outlet conduit in the inner zone, defining an aeration path passing through a rear zone, an outer zone, a front zone and the inner zone of the insole.

7. An item of footwear equipped with an aeration system, comprising:

an upper, configured to wrap around a top of a foot of a user;

a sole, connected to the upper and configured, in use, to come into contact with the ground;

the insole according to claim 1, configured to make contact with a bottom of the foot of the user and positioned above said sole and inside the upper.

* * * * *